US005749335A

United States Patent [19]

Flanery, Jr. et al.

[11] Patent Number: 5,749,335

[45] Date of Patent: May 12, 1998

[54] BARREL THROTTLE VALVE

[75] Inventors: Ansel Bernard Flanery, Jr., Brighton; Lowell Allan Reams, Canton; Mark Alan Zagata, Livonia, all of Mich.

[73] Assignee: Ford Global Technologies, Inc., Dearborn, Mich.

[21] Appl. No.: 679,917

[22] Filed: Jul. 15, 1996

[51] Int. Cl.[6] ..... F02D 9/16

[52] U.S. Cl. ..... 123/337

[58] Field of Search ..... 123/336, 337, 123/190.4; 251/315.08, 174, 315.16, 317, 172

[56] References Cited

U.S. PATENT DOCUMENTS

| | | | |
|---|---|---|---|
| 1,183,221 | 5/1916 | Miller . | |
| 1,265,588 | 5/1918 | Baverey . | |
| 1,664,747 | 4/1928 | Kamensky . | |
| 1,671,255 | 5/1928 | Porter . | |
| 2,012,020 | 8/1935 | Perrier | 261/18 |
| 3,620,195 | 11/1971 | Lamm | 123/337 |
| 3,948,227 | 4/1976 | Guenther | 123/190.17 |
| 4,119,077 | 10/1978 | Vallejos | 123/188 B |
| 4,271,096 | 6/1981 | Kobayashi | 261/62 |
| 4,341,188 | 7/1982 | Nerstrom | 123/324 |
| 4,356,801 | 11/1982 | Graham | 123/337 |
| 4,747,578 | 5/1988 | Kivipelto et al. | 251/159 |
| 4,778,148 | 10/1988 | Kruger | 251/174 |
| 4,778,184 | 10/1988 | Kruger | 251/174 |
| 4,794,895 | 1/1989 | Kruger | 123/190.17 |
| 4,909,211 | 3/1990 | Cook et al. | 123/337 |
| 4,979,756 | 12/1990 | Kambrock et al. | 277/27 |
| 5,105,784 | 4/1992 | Davis et al. | 123/337 |
| 5,330,156 | 7/1994 | McKavanagh | 251/159 |
| 5,478,047 | 12/1995 | Best et al. | 251/172 |
| 5,547,099 | 8/1996 | Chang | 220/212.5 |

FOREIGN PATENT DOCUMENTS

| | | |
|---|---|---|
| 437877 | 5/1912 | France . |
| 2529256 | 12/1983 | France . |
| 3800087 | 7/1989 | Germany . |
| 75531 | 6/1980 | Japan . |
| 201336 | 8/1988 | Japan . |
| 151731 | 6/1989 | Japan . |
| 10715 | 1/1994 | Japan . |
| 886313 | 9/1981 | U.S.S.R. . |
| 500320 | 2/1939 | United Kingdom . |

*Primary Examiner*—Willis R. Wolfe
*Assistant Examiner*—Hieu T. Vo
*Attorney, Agent, or Firm*—Donald A. Wilkinson

[57] ABSTRACT

A barrel throttle valve assembly (20) for use in an air intake system of an internal combustion engine. The barrel throttle valve assembly (20) includes a barrel (32) mounted within a housing (22), with the barrel (32) preferably including an upstream orifice (42), and idle notch (44) and a downstream orifice (46) for controlling the flow of idle air through the valve when the barrel (32) is in a substantially closed position, thus increasing the sensitivity of the valve at idle conditions. Also, preferably, a seal (48) and spring (54) is employed to reduce air leakage around the barrel (32).

12 Claims, 2 Drawing Sheets

BARREL THROTTLE VALVE

FIELD OF THE INVENTION

The present invention relates to air induction systems for internal combustion engines, and more particularly to barrel throttles valves employed in air induction systems.

BACKGROUND OF THE INVENTION

Internal combustion engines for passenger vehicles typically employ a butterfly valve in a throttle valve assembly to control air intake, whether it is employed in a plenum throttle or a port throttle configuration. While this arrangement works adequately, increases in horsepower can be had if the valve employed in the throttle assembly is a barrel valve rather than the conventional butterfly valve of equal port area. This is true because the butterfly valve shaft and plate remain in the airflow path, obstructing airflow at wide open throttle. A barrel throttle uses a flow opening through a barrel and a matching opening in a housing for the throttling orifice area from minimum to wide open by rotation of the barrel. At wide open throttle, the barrel throttle does not restrict airflow. Furthermore, barrel throttles also generally offer improved air flow sensitivity to throttle angle.

This horsepower improvement has been recognized in racing engines for years where barrel valves are routinely employed. However, in racing engines the concerns are much different than in passenger vehicles. Passenger vehicles have strict fuel economy standards that must be complied with as well as concerns with good idle quality. This is one of the reasons that passenger cars typically employ butterfly valves instead of barrel valves.

Consequently, difficulties arise with the employment of barrel throttles in passenger vehicles that are not concerns with conventional butterfly valves or with racing engines. For instance, barrel valves are more prone to leakage than butterfly valves. Current practice in race engines restricts leakage around barrel throttles by using tight clearances, which makes manufacturing more difficult and causes problems of binding and high friction from thermal expansion and mechanical distortions. Although not a problem for limited production race engines, it is a concern for the high volumes at which passenger vehicles are produced. Nonetheless, passenger vehicles will also require good sealing around a barrel valve, in this case, to allow for good idle quality. Thus a good long lasting seal is required around the throttle valve.

When employing a barrel valve, the need arises for good low resolution idle control without having to resort to the expense of idle air bypass lines or very high resolution motors controlling the valve. But, in order to do this, the flow past the barrel valve must be able to be controlled precisely at idle and low load conditions.

Further, for an engine with load control port throttles, this can be accomplished by using a small manifold connected to each of the ports downstream of the port throttles. This manifold is fed air form an actuator which controls the idle air flow. However, because this system interconnects the ports via the small manifold, it prevents the individual ports from recovering to atmospheric pressure during each cylinder's intake valve closed period due to the average level of vacuum maintained as a result of each cylinder being at a different part of the four stroke cycle. This lack of pressure recovery reduces or eliminates two of the important benefits of load control port throttles, namely, light/medium load pumping work being reduced, and idle quality being unaffected by residuals from high intake/exhaust valve overlap. A desire exists for precise regulation of idle air flow without interconnecting the individual ports, and therefore the benefits of load control port throttles can be maintained.

This is particularly true for port throttle configurations. If there is leakage around the barrel, a problem which arises is precisely controlling the airflow and thus the air/fuel ratio equally from cylinder-to-cylinder at idle and part load engine conditions. Air/fuel ratio balance from cylinder-to-cylinder is not critical in race engines but is of importance in applying barrel port throttles to production motor vehicles, where as stated above engine stability at idle, idle quality are design constraints.

Moreover, port throttles in general are becoming more prevalent in passenger vehicles because of advantages in power output control that can be had by employing a port throttle type of design with at least one throttle valve per cylinder. Moreover, intake port barrel throttles also provide good transient throttle response.

Another concern when employing a barrel throttle rather than a butterfly valve is its increased overall size relative to the throttle plate design, creating packaging concerns in the engine compartment. This is especially true for port throttle configurations, having multiple throttle valves. A desire exists, then, to employ barrel throttles in a port throttle configuration without unduly increasing its size over equivalent butterfly valves.

SUMMARY OF THE INVENTION

In its embodiments, the present invention contemplates a barrel throttle valve for use in the air stream of an intake system of an internal combustion engine. The barrel throttle valve comprises a throttle valve housing having a barrel cavity enclosed therein and a main bore extending from the barrel cavity, with the main bore and barrel cavity enclosing a portion of the air stream. A barrel is rotatably mounted within the barrel cavity, having a primary bore selectively alignable with the main bore and forming an upstream land and a downstream land. The barrel further includes an idle control notch formed in the downstream land and means for receiving air through the upstream land. The barrel throttle valve also includes means for controlling the rotational motion of the barrel valve within the throttle body to allow for selective changing of the idle air flow past the barrel.

Accordingly, an object of the present invention is to provide an idle air control system for an internal combustion engine using a notch in a barrel throttle to precisely control air flow for engine idle conditions, thus eliminating the need for a separate idle air control passage and control system, particularly for a port throttle configuration.

An advantage of the present invention is that a barrel valve is provided which will precisely control air flow to provide for increased horsepower over an equivalent butterfly valve throttle of equal port size, while allowing for stable idle.

A further advantage of the present invention is that the barrel valve maintains adequate sealing around the barrel for precise idle air flow control by the idle notch at idle and light load conditions, particularly maintaining good cylinder-to-cylinder distribution for port throttle configurations.

An additional advantage of the present invention is that barrel valves are employed in a port throttle configuration with minimal increase in package size from a conventional butterfly valve configuration by off-setting the primary bore in the barrel valve.

DETAILED DESCRIPTION OF THE PREFERRED EMBODIMENTS

Figure 1:
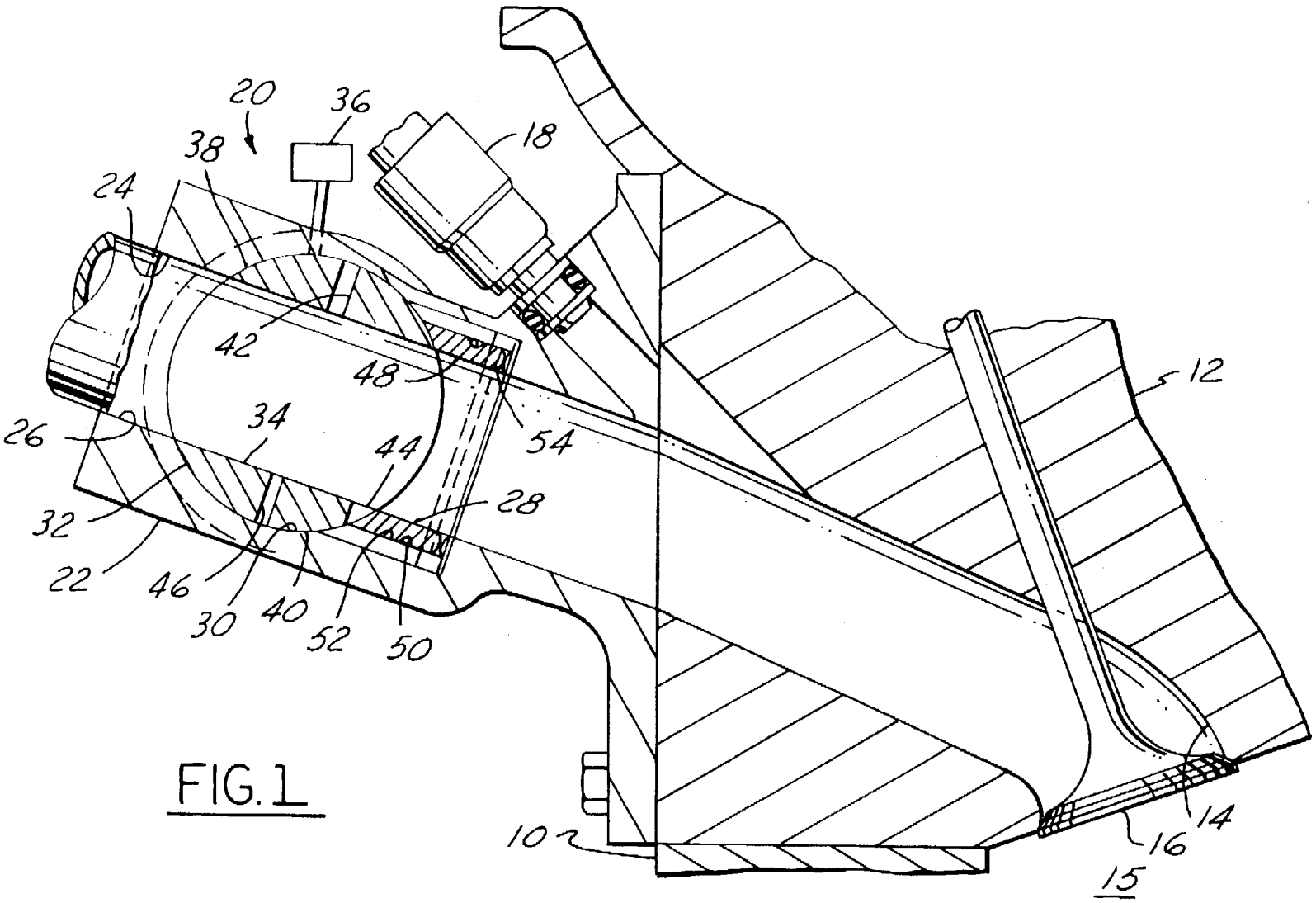
FIG. 1 is a side, partially sectional view of a portion of an intake system for an internal combustion engine in accordance with the present invention
Figure 2:
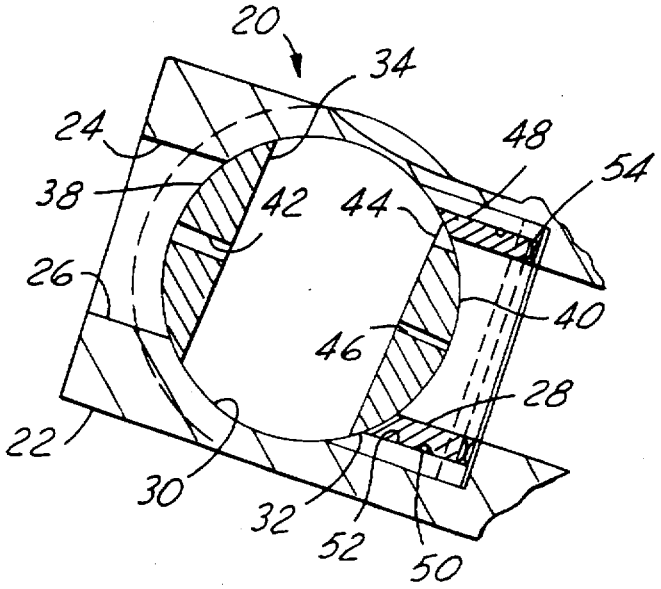
FIG. 2 is a side, partially sectional view of a barrel throttle valve similar to FIG. 1, with the throttle valve in a different position.

FIGS. 1 and 2 illustrate a portion of a cylinder head 12 mounted on a cylinder block 10 of an internal combustion engine. An intake port 14 extends through the head 12, with an intake valve 16 mounted within the intake port 14 at its downstream end to selectively restrict the flow into an engine cylinder 15 in a conventional manner. A fuel injector 18 is mounted relative to the head 12 for injecting fuel into the air flowing through the intake port 14.

A barrel throttle valve assembly 20 mounts to the upstream end of the intake port 14. The throttle valve assembly 20 is illustrated in FIG. 1 as a port throttle design, with at least one throttle valve for each cylinder 15, although the barrel throttle valve assembly 20 of the present invention is also applicable to plenum type intake systems with one throttle valve controlling the air flow into multiple cylinders.

The barrel throttle valve assembly 20 includes a barrel housing 22 having a main bore 24, with an upstream end 26 and a downstream end 28, the downstream end 28 aligning with, mating to and preferably the same cross-sectional shape as the upstream end of the intake port 14. The upstream end 26 of the main bore 24 receives air from a conventional portion of the air intake system (not shown). Between the upstream end 26 and downstream end 28 of the main bore is a barrel cavity 30, having a generally cylindrical surface.

A barrel 32, having a generally cylindrical outer surface which matches the surface of the barrel cavity 30 but of a slightly smaller nominal diameter, mounts within the barrel cavity 30. The barrel 32 is selectively rotatable within the cavity 30 by a conventional controller 36, illustrated schematically in FIG. 1.

The barrel 32 includes a generally cylindrical primary bore 34 generally through its center and extending normal to the axis of rotation of the barrel 32. The primary bore 34 selectively aligns with, mates to and is preferably of the same general cross-sectional shape as the main bore 24 in the housing 22. Two lands, in effect, are formed by the primary bore 34 extending through the barrel 32, an upstream radial land 38 and a downstream radial land 40. By rotating the barrel 32 relative to the housing 22, the lands act to selectively restrict the flow through the throttle valve assembly 20.

FIG. 1 illustrates a barrel position under a wide open throttle engine condition, where the primary bore 34 is fully aligned with the main bore 24 (fully open), minimizing any restrictions to air flow. FIG. 2 illustrates an idle condition (fully closed), where the lands 38, 40 essentially block the flow, except for idle air flow, as discussed below.

Figure 6:
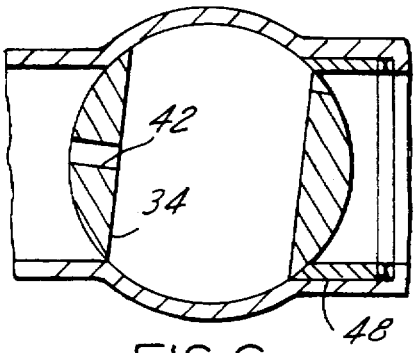
FIG. 6 is a partial side elevation view similar to FIG. 2 illustrating the barrel valve in a partially open position and without a downstream orifice.

The barrel 32 also includes an upstream orifice 42 through the upstream land 38, which allows air flow through from the upstream end 26 of the main bore 24 to the primary bore 34 when the barrel 32 is partially and fully closed. The downstream land 40 on the barrel 32 includes an idle notch 44, which allows for air flow from the primary bore 34 to the downstream end 28 of the main bore 24 when the barrel 32 is in its substantially closed position. The air can then flow through the upstream orifice 42, through the primary bore 34 and through the idle notch 44 when the barrel 32 is substantially closed. The amount of air flow will depend upon the exact angle of the barrel 32, which determines how much of the notch is open to allow air flow. (FIG. 6 illustrates this configuration).

Also, preferably, the barrel 32 includes a downstream orifice 46 though the downstream land 40 (FIGS. 1 and 2). This orifice would be smaller than the upstream orifice 42. The downstream orifice 46 allows air flow for engine idle conditions in order to reduce the size of the idle notch 44 needed. The notch 44 sized to allow for a small amount of flow through it when the barrel 32 is fully closed such that the total flow through the notch 44 and downstream orifice 46 will create a baseline air flow. Small rotations of the barrel 32 from the fully closed position then, will cause increased air flow through the notch 44. In this way, the notch 44 acts to adjust the airflow upwardly from the baseline if more air flow is needed for that particular engine idle condition.

By employing the notch 44 in this way, the resolution of the controller 36 for barrel rotation need not be as high as with a conventional barrel throttle assembly that does not have a notch where the barrel position is changed to adjust the flow through the primary bore 34 for varying idle conditions. Thus, high accuracy of flow can be maintained. By increasing the sensitivity in this way, the variability from cylinder-to-cylinder in a port throttle configuration is reduced.

Also, preferably, to further assure accurate flow of idle air, a seal 48 is employed to prevent air leakage between the barrel 32 and barrel cavity 30. The downstream end 28 of the main bore 24 includes a recess 52 for receiving and retaining the seal 48. The seal 48 is a sliding (rubbing) seal and is made of a low friction coefficient material with its rubbing surface matching the radius of the barrel 32 for good sealing geometry.

A spring 54, preferably a wave spring, is mounted between the downstream end of the cavity 52 and the seal 48, in order to bias the seal 48 against the barrel 32. The spring loading will not only maintain a good seal as originally manufactured, but will also compensate for wear of the seal to barrel surface. Further, between the seal 48 and barrel housing 22 is mounted an O-ring 50, or similar type seal, in order to prevent leakage around the seal 48 through the recess 52. This rubbing seal 48 configuration allows more effective use of the idle notch 44 for more sensitive idle air control. This avoids a concern with unequal cylinder-to-cylinder airflow due to barrel bypass leakage in a port throttle configuration and makes a more manufacturable design that maintains adequate stability at idle.

Figure 4:
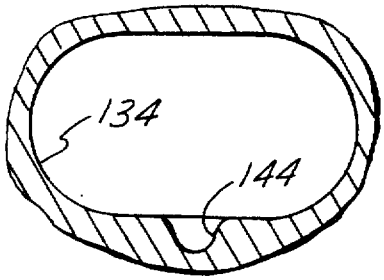
FIGS. 3 and 4 show a second embodiment having an elongated cross-sectional shape for the primary bore of the barrel valve, in accordance with the present invention.
Figure 3:
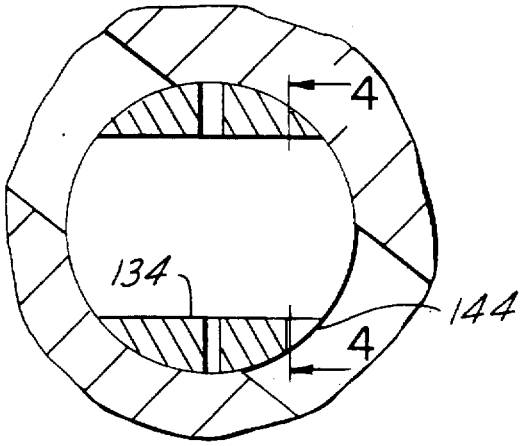

A second embodiment is illustrated in FIGS. 3 and 4. In this embodiment, the elements which are the same as the first embodiment are so designated and those which are modified are designated similarly to the first embodiment, but using 100-series numbers. Here, the throttle valve is essentially the same but the cross-sectional shape of the primary bore 134 is oblong and the idle notch 144 is located in the center bottom of the primary bore 134.

Figure 5:
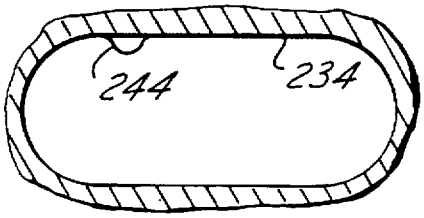
FIG. 5 is a view similar to FIG. 4, showing a third embodiment with a different cross-sectional shape for the primary bore of the barrel valve in accordance with the present invention.

A third embodiment is illustrated in FIG. 5. In this embodiment, the primary bore 234 is oval shaped and the idle notch 244 is offset to one side of the primary bore 234. This will promote a swirl component to the intake air charge at light engine loads for a port throttle design, further improving combustion.

Figure 7:
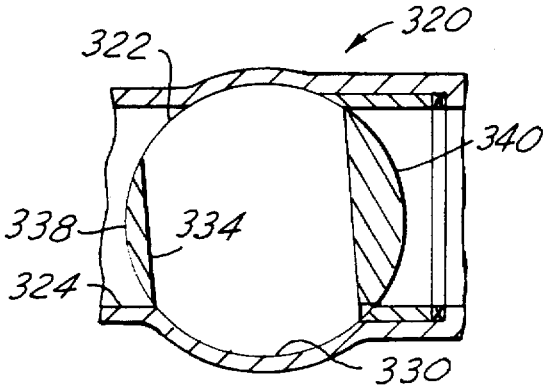
FIG. 7 is a partial side elevation view similar to FIG. 2 illustrating a fourth embodiment of the present invention with an off-set primary bore.

A fourth embodiment is illustrated in FIG. 7. In order to minimize the overall size of the barrel throttle valve assembly 320, the barrel 332 and barrel cavity 330 are offset from center. The primary bore 334 is offset from center in the opposite direction so that it completely aligns with the main bore 324 at full open throttle. By off-setting the barrel 332, an increase in the downstream radial seal land 340 on the outlet side of the barrel 332 is achieved as the upstream land 338 is decreased. Now, the diameter of the barrel 332 can be reduced until the downstream land 340 is again equal to the original size it would have been with the primary bore in the center of the barrel. Thus, a reduced barrel diameter is achieved, and hence, an overall reduction in the barrel throttle valve 320 size.

While certain embodiments of the present invention have been described in detail, those familiar with the art to which this invention relates will recognize various alternative designs and embodiments for practicing the invention as defined by the following claims.

We claim:

1. A barrel throttle valve for use in the air stream of an intake system of an internal combustion engine comprising:

a throttle valve housing having a barrel cavity enclosed therein and a main bore extending from the barrel cavity, with the main bore and barrel cavity enclosing a portion of the air stream;

a barrel rotatably mounted within the barrel cavity, having a primary bore selectively alignable with the main bore and forming an upstream land and a downstream land, with the barrel further including an idle control notch formed in the downstream land and including means for receiving air through the upstream land; and means for controlling the rotational motion of the barrel valve within the throttle body to allow for selective changing of the idle air flow past the barrel.

2. The barrel throttle valve of claim 1 wherein the barrel throttle valve is adapted to form a portion of a port throttle system.

3. The barrel throttle valve of claim 1 wherein the means for receiving air through the upstream land is a first orifice extending through the upstream land.

4. The barrel throttle valve of claim 1 wherein the barrel valve further includes a second orifice extending through the downstream land.

5. The barrel throttle valve of claim 1 wherein the barrel cavity is off-center from the main bore and the primary bore of the barrel is off-center with the barrel such that the primary bore is still selectively alignable with the main bore.

6. The barrel throttle valve of claim 1 wherein the main bore further includes a recess adjacent the barrel cavity, with the recess retaining a seal and spring, the spring biasing the seal into surface contact with the barrel valve.

7. A barrel throttle valve for use in the air stream of an air intake system of an internal combustion engine comprising:

a throttle valve housing having a barrel cavity enclosed therein and a main bore extending from the barrel cavity, with the main bore and barrel cavity enclosing a portion of the air stream, and the main bore including a seal recess adjacent the barrel cavity;

a barrel rotatably mounted within the barrel cavity, having a primary bore selectively alignable with the main bore and forming an upstream land and a downstream land, with the barrel further including an idle control notch formed in the downstream land and including a first orifice extending through the upstream land; and a seal and spring, retained within the seal recess, with the spring biasing the seal into surface contact with the barrel.

8. The barrel throttle valve of claim 7 wherein the barrel further includes a second orifice extending through the downstream land.

9. The barrel throttle valve of claim 8 wherein the barrel cavity is off-center from the main bore and the primary bore of the barrel is off-center with the barrel such that the primary bore is still selectively alignable with the main bore.

10. The barrel throttle valve of claim 7 wherein the spring is a wave spring.

11. A barrel throttle valve for use in the air stream of an air intake system of an internal combustion engine comprising:

a throttle valve housing having a barrel cavity enclosed therein and a main bore extending from the barrel cavity, with the main bore and barrel cavity enclosing a portion of the air stream and the barrel cavity off-center from the main bore; and a barrel rotatably mounted within the barrel cavity, having a primary bore, off-center with the barrel, selectively alignable with the main bore and forming an upstream land and a downstream land, with the barrel further including an idle control notch formed in the downstream land and including means for receiving air through the upstream land.

12. The barrel valve of claim 11 wherein the barrel throttle valve further includes a second orifice extending through the downstream land and wherein the main bore further includes a recess adjacent the barrel cavity, with the recess retaining a seal and spring, the spring biasing the seal into surface contact with the barrel valve.

* * * * *